US009926676B1

(12) United States Patent
Beckhusen

(10) Patent No.: US 9,926,676 B1
(45) Date of Patent: Mar. 27, 2018

(54) LOCKING MECHANISM FOR REMOVABLE BASE PLATE ON VIBRATORY COMPACTOR

(71) Applicant: Caterpillar Inc., Peoria, IL (US)

(72) Inventor: Jordan R. Beckhusen, Robinson, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/278,345

(22) Filed: Sep. 28, 2016

(51) Int. Cl.

| | |
|---|---|
| ***E01C 19/00*** | (2006.01) |
| ***E01C 19/34*** | (2006.01) |
| ***E02D 3/046*** | (2006.01) |
| ***E01C 19/38*** | (2006.01) |
| ***F15B 11/08*** | (2006.01) |

(Continued)

(52) U.S. Cl.
CPC ..... *E01C 19/34* (2013.01); *E01C 19/38* (2013.01); *E02D 3/046* (2013.01); *F15B 11/08* (2013.01); *F15B 13/0402* (2013.01); *F15B 13/0426* (2013.01)

(58) Field of Classification Search
CPC ..... E01C 19/34; E01C 19/38; E02D 3/046; F15B 11/08; F15B 13/0402; F15B 13/0426
USPC ..... 404/84.05, 133.05–133.2; 173/162.1, 173/210, 90
See application file for complete search history.

(56) References Cited

U.S. PATENT DOCUMENTS 3,283,677 A * 11/1966 Uebel ..... E01C 19/41 404/113
3,508,476 A * 4/1970 Smith ..... E01C 19/405 280/446.1

(Continued)

FOREIGN PATENT DOCUMENTS

DE 2030534 6/1970
DE 29700432 5/1997

(Continued)

OTHER PUBLICATIONS

Product Brochure for ALLU® V Vibrating Plate.

*Primary Examiner* — Raymond W Addie
(74) *Attorney, Agent, or Firm* — Finnegan, Henderson, Farabow, Garrett & Dunner, LLP

(57) ABSTRACT

A locking mechanism for a base plate of a vibratory compactor includes a locking actuator configured to alternately lock and unlock the base plate relative to the vibratory compactor, and a hydraulic control circuit in fluid communication with a source of pressurized hydraulic fluid and the locking actuator. The hydraulic control circuit includes a hydraulic pilot-pressure-actuated, 2-position spool valve, wherein the spool valve is configured to move to a first position when pressurized hydraulic fluid from the source is supplied to the spool valve in a first direction, and move to a second position when the pressurized hydraulic fluid from the source is supplied to the spool valve in a second direction. In the first position of the spool valve the pressurized hydraulic fluid moves the locking actuator to a locked position, and after the locking actuator is in the (Continued)

locked position, the pressurized hydraulic fluid operates a hydraulic motor configured to power the vibratory compactor. In the second position of the spool valve the pressurized hydraulic fluid moves the locking actuator to an unlocked position.

20 Claims, 5 Drawing Sheets

(51) Int. Cl.
*F15B 13/04* (2006.01)
*F15B 13/042* (2006.01)

(56) References Cited

U.S. PATENT DOCUMENTS 3,618,485 A * 11/1971 Hermann ..... E02D 3/074 404/117
3,814,533 A * 6/1974 Buck ..... E02D 3/074 404/117
3,909,149 A * 9/1975 Century ..... E02D 3/074 173/162.1
3,972,637 A * 8/1976 Sutherland ..... E02D 3/074 404/113
4,735,523 A * 4/1988 Ishikawa ..... E02D 3/074 212/349
4,790,687 A * 12/1988 Wright ..... E02D 3/046 37/367
5,149,225 A * 9/1992 Artzberger ..... E02D 3/074 404/133.1
5,957,622 A 9/1999 Vera-Montiel
6,435,767 B1 * 8/2002 Steffen ..... E01C 19/38 404/133.05
6,551,022 B1 * 4/2003 Stayner ..... E01C 19/38 404/133.05
7,080,958 B1 * 7/2006 Morris ..... E02D 7/18 173/162.1
7,354,221 B2 4/2008 Congdon
7,753,621 B2 7/2010 Steffen
8,562,258 B2 * 10/2013 Wissmann ..... E02D 3/02 405/232

FOREIGN PATENT DOCUMENTS

EP 2083123 10/2008
JP H09-105236 4/1997

* cited by examiner

LOCKING MECHANISM FOR REMOVABLE BASE PLATE ON VIBRATORY COMPACTOR

TECHNICAL FIELD

The present disclosure relates to vibratory compactors and, more particularly, the locking mechanism for a removable base plate on a vibratory compactor.

BACKGROUND

Many projects require compacting a surface. For example, various types of construction projects may require compacting surfaces formed by substances like soil, gravel, and asphalt. Various types of specialized machines exist for compacting such surfaces, including, but not limited to, surface rollers and vibrating plates. Such surface compactors operate by applying downward force on the surface with a base of the surface compactor, which base may include, for example, one or more rollers and/or one or more base plates.

Some surface compactors include a vibratory mechanism for generating a fluctuating vertical force on the base of the surface compactor to enhance surface compaction. The results achieved by such a surface compactor may depend in part on the amplitude of the fluctuating vertical force generated by the vibratory mechanism. Accordingly, there exist various control methods for adjusting the magnitude of the fluctuating vertical force to achieve different results. In many existing vibratory compactors, a single base plate is welded to the bottom of the vibratory unit. In some instances, an engine or hydraulic motor controllably rotates at least one eccentric mass to impart vibratory motion at a particular frequency to the base plate. The result is an oscillatory force with the frequency of the speed of rotation, and an amplitude dependent on the mass eccentricity and speed of rotation. Variations on this basic system include multiple eccentric weights and/or shafts such that by changing the phasing of the multiple weights and/or shafts, the degree of force created by the eccentric masses can be varied. Vibratory compactors may also include a removable base plate, such that various sized and shaped base plates may be used with the same vibratory mechanism, and worn or damaged base plates may be readily replaced. In cases where the base plate is removable, a locking mechanism is provided to hold the base plate in place during operation of the vibratory compactor. Existing locking mechanisms for removable base plates on vibratory compactors usually require separate structures and control systems that require multiple control inputs and must be operated independently from the hydraulic lines and fluid flow used for operating the vibratory mechanism.

European Patent EP 2083123 A2 to Schrode ("the EP '123 patent") discloses a vibratory compactor with a removable base plate. In the EP '123 patent a quick-release latch is actuated by a double-acting hydraulic cylinder configured to receive hydraulic fluid from an excavator that operatively carries the vibratory compactor. Although the EP '123 patent provides a means for removably attaching a base plate to a vibratory compactor, a special hydraulic connector and associated additional hydraulic lines are required for connection to the hydraulic fluid supply of the excavator. The hydraulic connector includes two pressure ports, and each of the pressure ports is connected to an input of a valve that supplies the pressurized hydraulic fluid to a two-position, 4-way control valve. The control valve must be actuated independently from the direction of flow of hydraulic fluid from the excavator in order to control the supply of hydraulic fluid to the double-acting hydraulic cylinder for locking and unlocking the base plate. The base plate remains locked regardless of which direction the hydraulic fluid is flowing to and from the hydraulic motor used to operate a vibratory mechanism, and the vibratory mechanism may be operated in both flow directions.

Although the EP '123 patent discloses an apparatus and method for removably attaching a base plate to a vibratory compactor, the additional hydraulic connector, associated additional hydraulic lines, and additional control valves requiring user inputs to lock and unlock the base plate increase costs, operational control complexities, operator training, and servicing challenges. Additionally, the ability to operate the vibratory mechanism in either direction of hydraulic fluid flow from the excavator, while also using the hydraulic fluid flow from the excavator to lock and unlock the base plate increases the complexity and costs associated with the locking mechanism.

The methods and apparatus for locking a removable base plate of a vibratory compactor according to the present disclosure solve one or more of the problems set forth above.

SUMMARY OF THE INVENTION

One aspect of the present disclosure is directed to a locking mechanism for a base plate of a vibratory compactor. The locking mechanism includes a locking actuator configured to alternately lock and unlock the base plate relative to the vibratory compactor, and a hydraulic control circuit in fluid communication with a source of pressurized hydraulic fluid and the locking actuator. The hydraulic control circuit includes a hydraulic pilot-pressure-actuated, 2-position spool valve. The spool valve is configured to move to a first position when pressurized hydraulic fluid from the source is supplied to the spool valve in a first direction, and move to a second position when the pressurized hydraulic fluid from the source is supplied to the spool valve in a second direction. In the first position of the spool valve the pressurized hydraulic fluid flows through the spool valve and through a first flow passage to a second side of the locking actuator to move the locking actuator to a locked position. After the locking actuator is in the locked position, the pressurized hydraulic fluid flows through the spool valve and through a second flow passage to a hydraulic motor configured to power the vibratory compactor. In the second position of the spool valve the pressurized hydraulic fluid flows through the spool valve and through a third flow passage to a first side of the locking actuator to move the locking actuator to an unlocked position. After the locking actuator is in the unlocked position, the pressurized hydraulic fluid is diverted from the third flow passage to flow back to the spool valve and to the source of pressurized hydraulic fluid.

Another aspect of the present disclosure is directed to a vibratory compactor including a vibratory mechanism, a hydraulic motor configured to drive the vibratory mechanism, a removable base plate, and a locking mechanism for selectively engaging the removable base plate to retain the removable base plate on the vibratory compactor. The locking mechanism includes a locking actuator configured to alternately lock and unlock the base plate relative to the vibratory compactor, and a hydraulic control circuit in fluid communication with a source of pressurized hydraulic fluid and the locking actuator. The hydraulic control circuit includes a hydraulic pilot-pressure-actuated, 2-position spool valve. The spool valve is configured to move to a first position when pressurized hydraulic fluid from the source is supplied to the spool valve in a first direction, and move to a second position when the pressurized hydraulic fluid from the source is supplied to the spool valve in a second direction. In the first position of the spool valve the pressurized hydraulic fluid flows through the spool valve and through a first flow passage to a second side of the locking actuator to move the locking actuator to a locked position. After the locking actuator is in the locked position, the pressurized hydraulic fluid flows through the spool valve and through a second flow passage to the hydraulic motor. In the second position of the spool valve the pressurized hydraulic fluid flows through the spool valve and through a third flow passage to a first side of the locking actuator to move the locking actuator to an unlocked position. After the locking actuator is in the unlocked position, the pressurized hydraulic fluid is diverted from the third flow passage to flow back to the spool valve and to the source.

Yet another aspect of the present disclosure is directed to a vibratory compactor including a vibratory mechanism, a hydraulic motor configured to drive the vibratory mechanism, a removable base plate, and a locking mechanism for selectively engaging the removable base plate to retain the removable base plate on the vibratory compactor. The locking mechanism includes a locking actuator configured to alternately lock and unlock the base plate relative to the vibratory compactor, and a hydraulic control circuit in fluid communication with a source of pressurized hydraulic fluid and the locking actuator. The hydraulic control circuit is configured such that the only control input received by the control circuit from outside of the control circuit is the direction of flow of the pressurized hydraulic fluid supplied to the control circuit from the source of pressurized hydraulic fluid. Flow of the hydraulic fluid in a first direction causes the locking actuator to lock the base plate relative to the vibratory compactor, and the hydraulic motor operates to drive the vibratory mechanism. Flow of the hydraulic fluid in a second direction opposite from the first direction causes the locking actuator to unlock the base plate relative to the vibratory compactor, and operation of the hydraulic motor is stopped.

DETAILED DESCRIPTION

Figure 1:
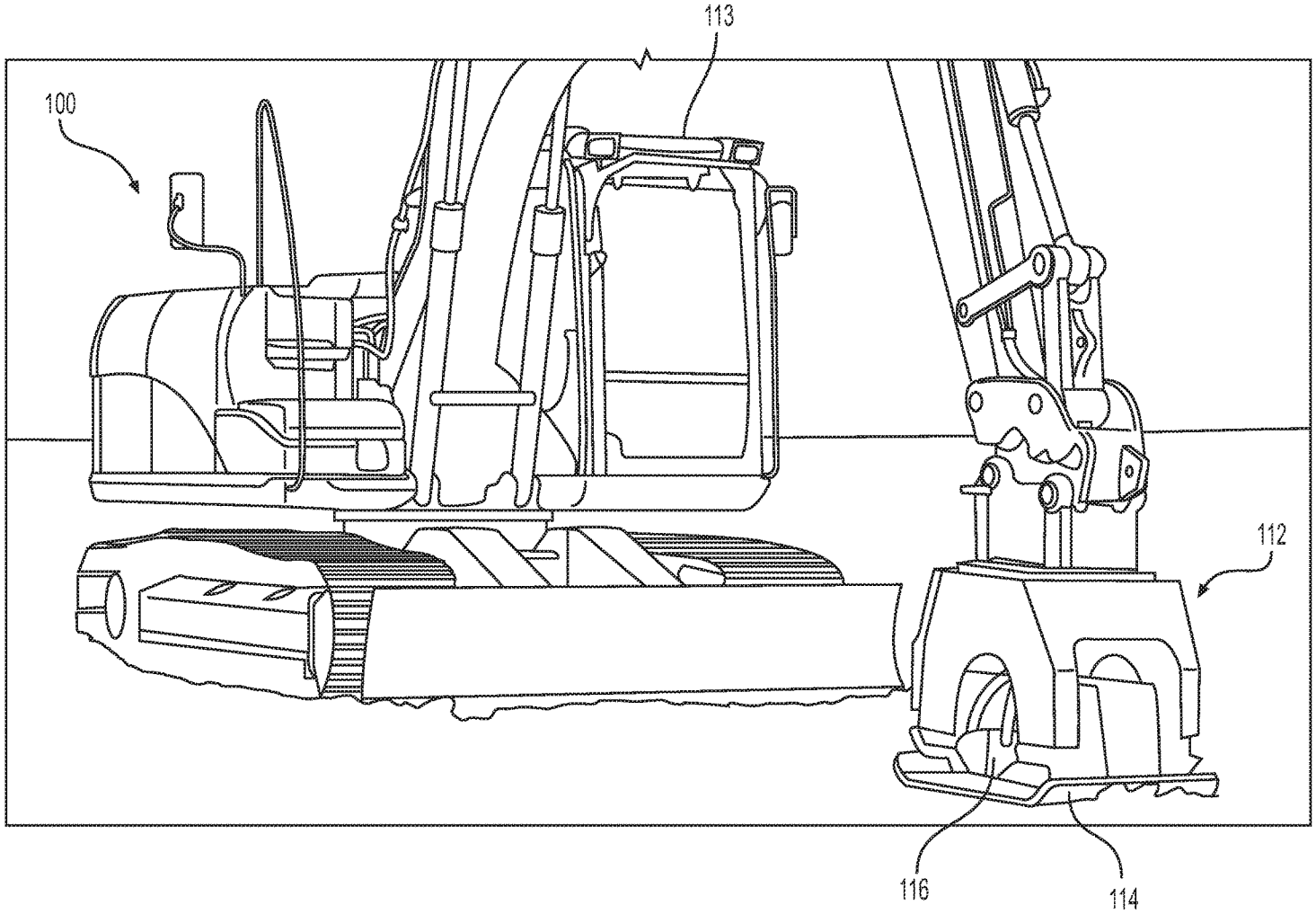
FIG. 1 illustrates one embodiment of a vibratory compactor attachment carried by an excavator and including a removable base plate with a locking mechanism according to the present disclosure.
Figure 2:
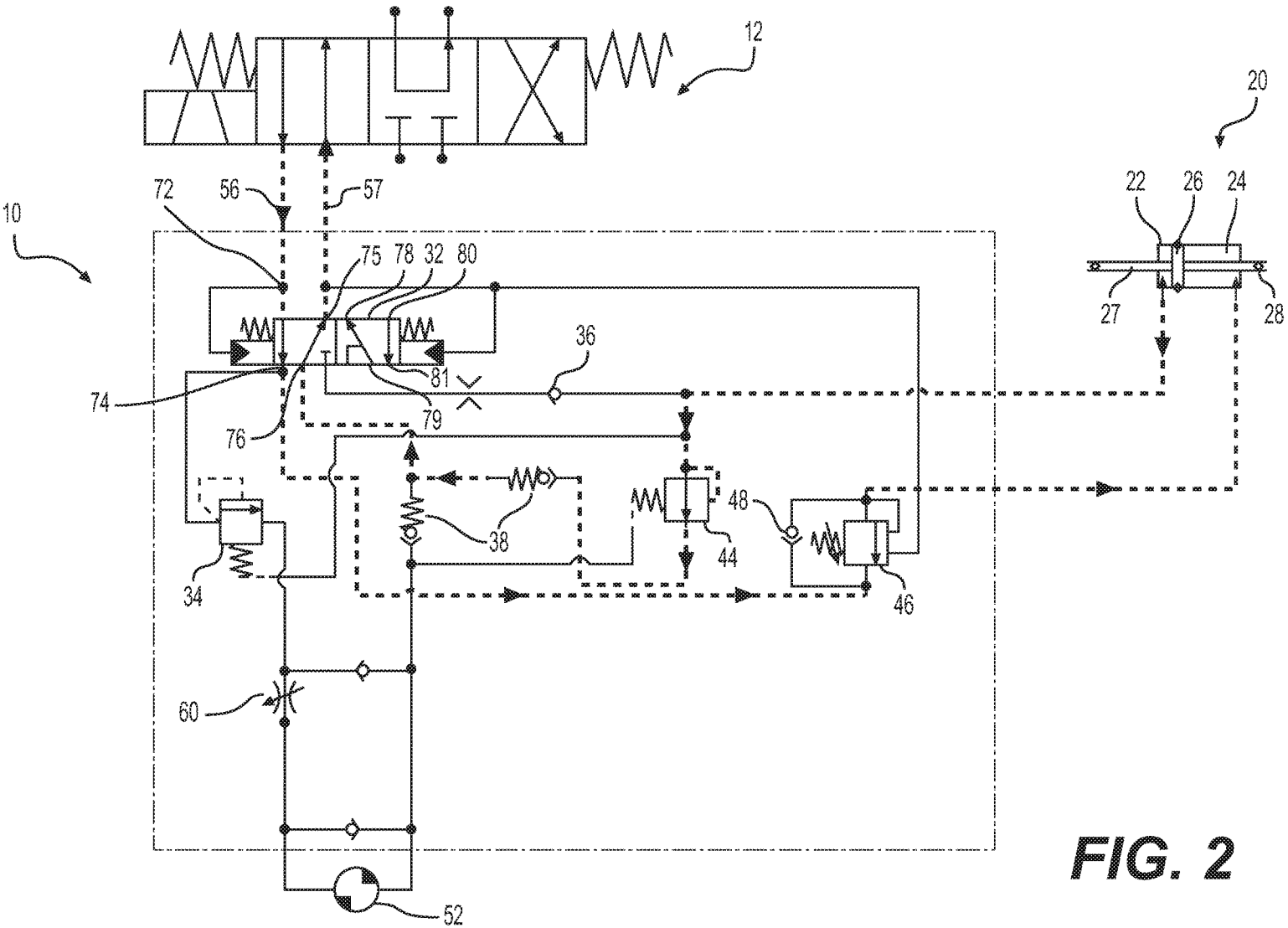
FIG. 2 is a schematic diagram of a hydraulic circuit for an embodiment of the present disclosure, with hydraulic fluid being provided to the hydraulic circuit in a first direction.

FIG. 1 illustrates an excavator 100, including a vibratory compactor attachment 112. The vibratory compactor shown is a vibratory plate-type compactor attachment, which includes a contact base plate 114, and one or more vibratory mechanisms 116 configured to actuate the base plate 114 to produce vibration. The vibratory compactor 112 may include a hydraulic circuit 10 configured to supply hydraulic fluid to one or more hydraulic motors that power the vibratory mechanisms 116, and to one or more locking actuators 20 (FIG. 2). The one or more locking actuators 20 are configured to lock and unlock the base plate 114 relative to the vibratory compactor 112.

The vibratory compactor 112 may be used to compact a variety of densifiable strata. In various alternative implementations, the vibratory compactor 112 may be carried by machines other than the excavator shown in FIG. 1, or may be a self-contained unit that is controlled and operated manually or by other means. The source of pressurized hydraulic fluid supplied to the hydraulic circuit 10 of the vibratory compactor may be located on the excavator and controlled by an operator, and a solenoid-controlled hydraulic fluid supply valve 12 may be activated by an operator sitting in a cabin 113 of the excavator 100. The operator may activate the hydraulic fluid supply valve 12 to direct the pressurized hydraulic fluid to one of a first hydraulic line 56 or a second hydraulic line 57 fluidly coupled to the hydraulic circuit 10, with the hydraulic fluid being returned to the source from the hydraulic circuit 10 through the other of the first and second hydraulic lines.

Figure 3:
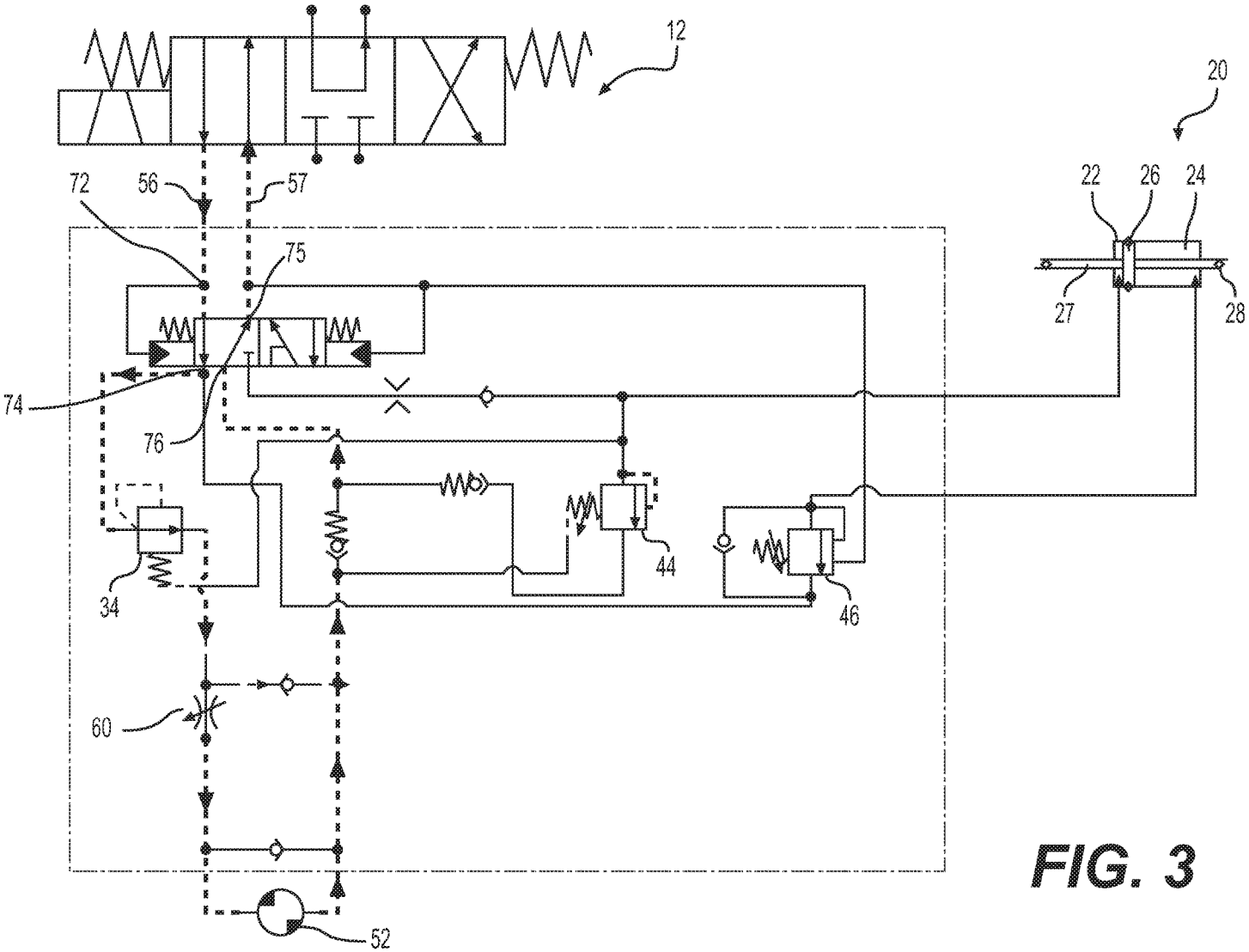
FIG. 3 is a schematic diagram of the hydraulic circuit of FIG. 2, with the locking mechanism for the base plate in a locked position, and with hydraulic fluid being provided to a hydraulic motor of a vibratory mechanism for the vibratory compactor of FIG. 1.
Figure 5:
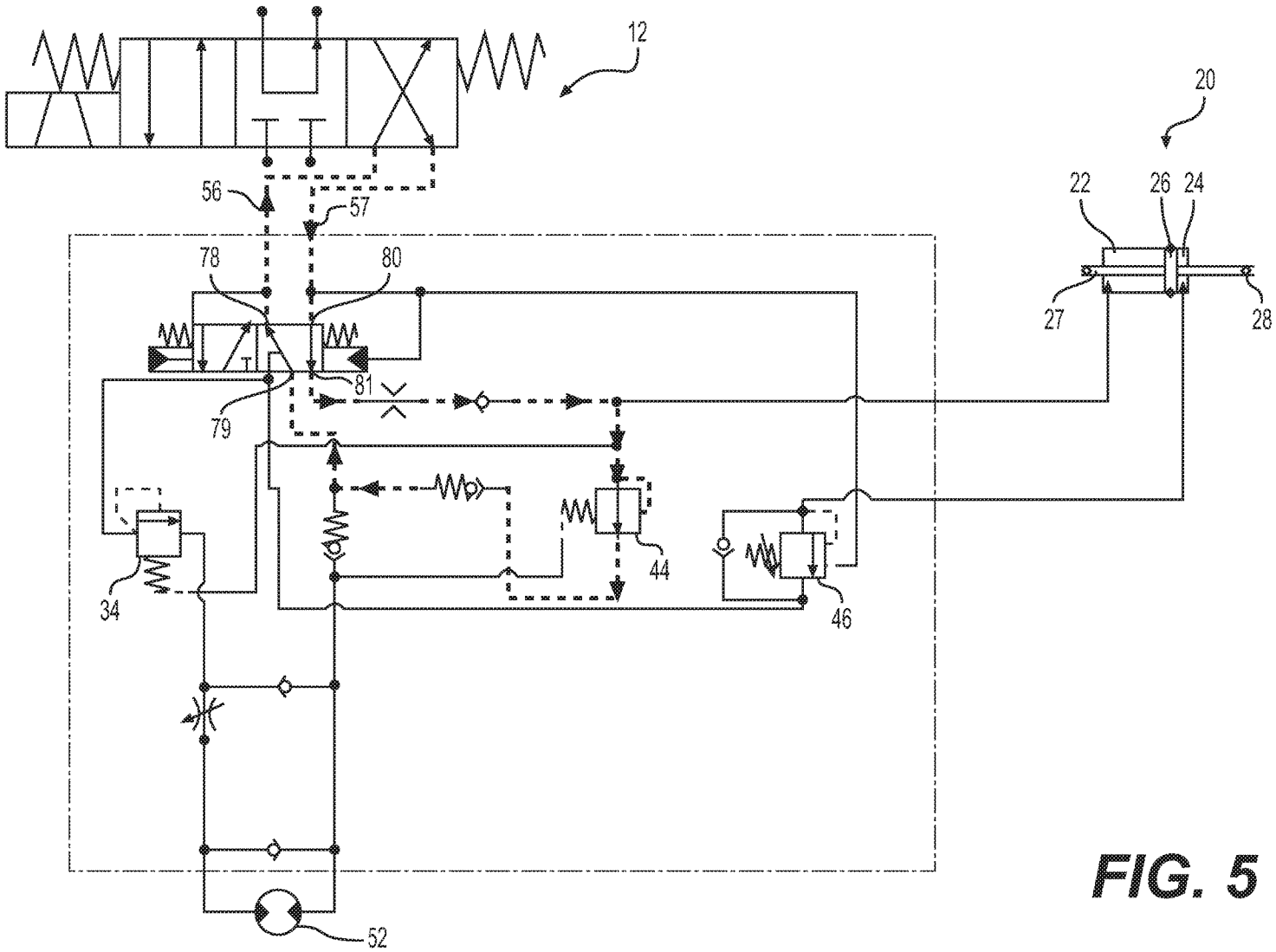
FIG. 5 is a schematic diagram of the hydraulic circuit of FIG. 4, with the locking mechanism for the base plate in an unlocked position.

The hydraulic circuit 10 according to embodiments of this disclosure may include hydraulic fluid lines that supply pressurized hydraulic fluid received from the excavator 100 to a hydraulic motor 52 configured to impart a rotational driving force to one or more unbalanced devices. In some exemplary implementations of this disclosure, the unbalanced devices are rotating eccentric masses that form part of each of the one or more vibratory mechanisms 116 associated with the base plate 114. Hydraulic fluid lines of hydraulic circuit 10 provide flow passages for supplying hydraulic fluid to the hydraulic motor 52, which operates the one or more vibratory mechanisms 116, and to one or more locking actuators 20, which control locking and unlocking of the base plate 114 to and from the vibratory compactor 112. In various exemplary embodiments of this disclosure, part or all of the hydraulic circuit 10 may be formed as one or more manifolds, with flow passages being defined within the manifold and with various fluid flow control devices fluidly coupled with the flow passages and/or hydraulic fluid lines. The locking actuator 20 may include a double-acting piston 26 slidable within a cylinder, with the piston 26 separating the cylinder into a first chamber 22 and a second chamber 24, and with a first piston rod 27 projecting from one face of the piston 26 through the first chamber 22, and a second piston rod 28 projecting from an opposite face of the piston 26 through the second chamber 24. Actuation of the piston 26 and first piston rod 27 all the way to the left, as shown in FIG. 3, causes a locking mechanism such as a rod or other latching device to engage with the base plate 114, while actuation of the piston 26 and second piston rod 28 all the way to the right, as shown in FIG. 5, causes the locking mechanism to disengage with the base plate 114, thereby allowing for installation and removal of the base plate 114 from the vibratory compactor 112. One of ordinary skill in the art will recognize that alternative implementations of this disclosure may include a reverse configuration in which movement of the piston and associated piston rods all the way to the right results in locking the base plate 114 relative to the vibratory compactor, and movement of the piston and associated piston rods all the way to the left results in unlocking the base plate. In some implementations more than one locking actuator may also be provided for a base plate.

The solenoid-controlled hydraulic fluid supply valve 12, selectively housed within the cabin 113 of the excavator 100 or at another location on the excavator, may be configured for directing hydraulic fluid from a source of pressurized hydraulic fluid on the excavator 100 to and from the hydraulic circuit 10. The solenoid-controlled hydraulic fluid supply valve 12 may be a 3-position valve activated by an operator of the excavator. As shown in FIG. 2, in a first position of the valve, pressurized hydraulic fluid flows from the excavator 100 in a first direction through the first hydraulic line 56 into the hydraulic circuit 10, and returns to the excavator from the hydraulic circuit 10 through the second hydraulic line 57. As described above, one or more of the hydraulic lines 56, 57 and/or flow passages within the hydraulic circuit 10 may be defined as flow passages within one or more manifolds.

As shown in FIGS. 2-5, flow of pressurized hydraulic fluid from the source on the excavator to the hydraulic circuit 10 in the first direction through the first hydraulic line 56 actuates a two-position, five-way hydraulic pilot-operated spool valve 32 into a first position, such as shown in FIGS. 2 and 3. The spool valve 32 is actuated to the right and into the first position in FIGS. 2 and 3 as a result of the pressurized hydraulic fluid that is supplied through the first hydraulic line 56 being at a higher pressure than the hydraulic fluid returning to the excavator through the second hydraulic line 57. The higher pressure incoming hydraulic fluid from the first hydraulic line 56 is partially diverted into the pilot line shown on the left side of the spool valve 32. Reversal of the direction of flow of the hydraulic fluid between the excavator 100 and the hydraulic circuit 10 results in the higher pressure incoming hydraulic fluid flowing from the excavator through the second hydraulic line 57 into the hydraulic circuit 10, and returning to the excavator 100 from the hydraulic circuit 10 through the first hydraulic line 56. In this direction of flow, the spool valve 32 is actuated to the left and into the second position shown in FIGS. 4 and 5 as a result of the higher pressure incoming hydraulic fluid partially diverting into the pilot line shown on the right side of the spool valve 32.

In the first position of the spool valve 32 the pressurized hydraulic fluid flow from the first hydraulic line 56 enters into a first port 72 of the spool valve, and exits the spool valve from a second port 74. The flow of the hydraulic fluid is represented by a dashed line leading from the second port 74 to a counter-balance valve 46 and associated bypass check valve 48, and into the second chamber 24 of the locking actuator 20. As shown in FIG. 2, the counter-balance valve 46 is in a closed position when the hydraulic fluid pressure is below a certain threshold pressure, but the associated bypass check valve 48 allows the hydraulic fluid to flow past the closed counter-balance valve 46 and into the second chamber 24 of the locking actuator 20. The counter-balance valve 46 is configured to open to allow hydraulic fluid from the second chamber 24 of the locking actuator 20 to flow back through the counter-balance valve 46 if a large force on the locking actuator 20 causes the pressure on the second side of the locking actuator to exceed the threshold pressure. Hydraulic fluid in the first chamber 22 of the locking actuator 20 exits the first chamber 22 as the piston 26 moves to the left in FIG. 2. The hydraulic fluid flows back through a pressure relief valve 44, through a spring-actuated check valve 38, into a third port 76 of the spool valve 32, and out of a fourth port 75 of the spool valve to return to the source of hydraulic fluid on the excavator through the second hydraulic line 57. As long as the piston 26 has not yet reached the far left position shown in FIG. 3, and hydraulic fluid is flowing into the second chamber 24 of the locking actuator 20 and out of the first chamber 22 of the locking actuator 20, the pressurized hydraulic fluid entering the spool valve 32 from the first hydraulic line 56 continues to follow the path represented by the dashed line in FIG. 2.

Once the locking actuator is in a fully locked position, with the piston 26 all the way to the left in locking actuator 20, as shown in FIG. 3, the pressurized hydraulic fluid entering the spool valve 32 through the first hydraulic line 56 can no longer continue to flow to the locking actuator 20 in the direction represented by the dashed lines in FIG. 2. With the locking actuator in the fully locked position pressure builds in a flow passage leading to a pressure-actuated sequence valve 34 downstream of the spool valve 32 until the sequence valve 34 is actuated to the open position that is shown in FIG. 3. With the locking actuator in the fully locked position, and the pressure-actuated sequence valve 34 open as shown in FIG. 3, the pressurized hydraulic fluid entering the hydraulic circuit 10 through the first hydraulic line 56 begins to flow through a throttle 60 and through the hydraulic motor 52, thereby operating the vibratory mechanisms 116 and vibrating the base plate 114.

Figure 4:
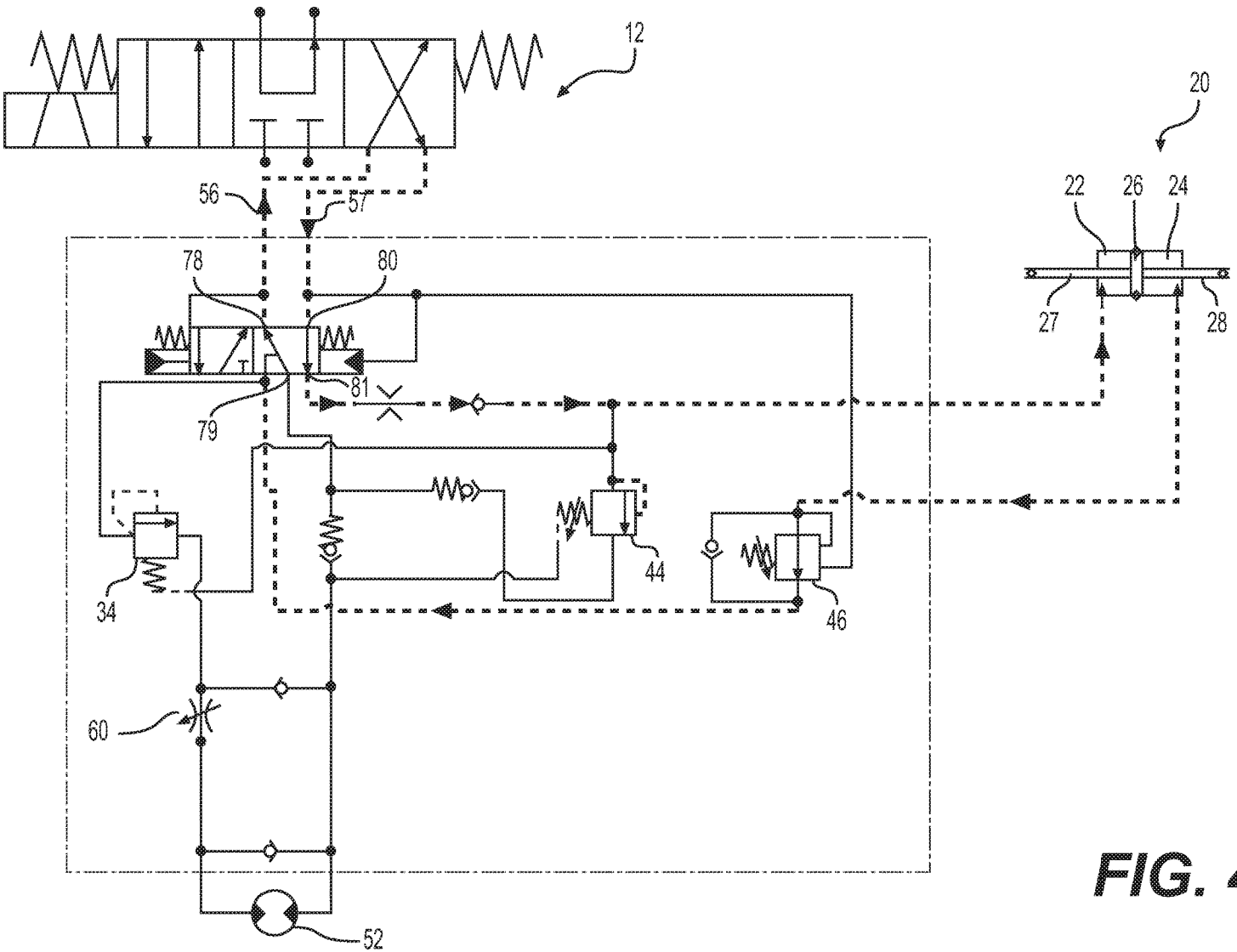
FIG. 4 is a schematic diagram of the hydraulic circuit of FIG. 2, with hydraulic fluid being provided to the hydraulic circuit in a second direction opposite from the first direction of FIG. 2.

As long as the pressurized hydraulic fluid from the excavator is supplied to the hydraulic circuit 10 in the first direction with the spool valve 32 in the first position, the base plate 114 will remain locked, the sequence valve 34 will remain open as shown in FIG. 3, and the hydraulic motor 52 will remain operational in order to impart vibration to the base plate 114. When the solenoid-operated hydraulic fluid supply valve 12 is actuated to a second position of the valve, pressurized hydraulic fluid may flow from the excavator 100 in a second direction through the second hydraulic line 57 into the hydraulic circuit 10, and may return to the excavator from the hydraulic circuit 10 through the first hydraulic line 56. Flow of hydraulic fluid from the excavator to the hydraulic circuit 10 in the second direction through the second hydraulic line 57 actuates the two-position, five-way hydraulic pilot-operated spool valve 32 into the second position, such as shown in FIGS. 4 and 5. The spool valve 32 is actuated to the left and into the second position shown in FIGS. 4 and 5 as a result of the higher pressure incoming hydraulic fluid diverting into the pilot line shown on the right side of the spool valve 32.

In the second position of the spool valve 32 the pressurized hydraulic fluid flow from the second hydraulic line 57 enters into a fifth port 80 of the spool valve, and exits from a sixth port 81. The flow of the hydraulic fluid is represented by a dashed line leading from the sixth port 81 into the first chamber 22 of the locking actuator 20. Hydraulic fluid in the second chamber 24 of the locking actuator 20 exits the second chamber 24 as the piston 26 moves to the right in FIG. 4, and the hydraulic fluid flows back through the counter-balance valve 46, into a seventh port 79 of the spool valve 32, and out of an eighth port 78 of the spool valve to return to the source of hydraulic fluid on the excavator through the first hydraulic line 56. As long as the piston 26 has not yet reached the far right position shown in FIG. 5, and the hydraulic fluid from the excavator is flowing into the first chamber 22 of the locking actuator 20 and out of the second chamber 24 of the locking actuator 20, the pressurized hydraulic fluid entering the spool valve 32 from the second hydraulic line 57 continues to follow the path represented by the dashed line in FIG. 4.

Once the locking actuator is in a fully unlocked position, with the piston 26 all the way to the right in locking actuator 20, as shown in FIG. 5, the pressurized hydraulic fluid entering the spool valve 32 through the second hydraulic line 57 can no longer continue to flow in the direction shown in FIG. 4, so pressure builds in the hydraulic line leading to the first chamber 22 of the locking actuator 20 until a pressure relief valve 44 off of the line leading to the locking actuator opens. The pressure relief valve 44 allows the pressurized hydraulic fluid to divert directly back to the port 79 of the spool valve 32 after passing through a check valve 38, through the spool valve to port 78, and back to the excavator through the first hydraulic line 56. This pressure-relieved hydraulic fluid flow loop is illustrated by the dashed line in FIG. 5. The locking actuator 20 will remain in the fully unlocked position of FIG. 5 as long as an operator holds the solenoid-operated hydraulic fluid supply valve 12 in the second position, or allows the fluid supply valve 12 to return to a third, neutral position.

To move the locking actuator 20 from the fully unlocked position of FIG. 5 back to the fully locked position of FIG. 3, the only action that needs to be taken by an operator is to reverse the direction of flow of hydraulic fluid supplied from the excavator 100 to the hydraulic circuit 10. As described above, the operator reverses the direction of flow of hydraulic fluid supplied from the excavator 100 to the hydraulic circuit 10 by activating the solenoid-operated hydraulic fluid supply valve 12. The hydraulic control circuit 10 and hydraulic control scheme of the present disclosure allows an operator to lock and unlock the locking actuator 20 in order to attach and remove the base plate 114 simply by changing the direction of hydraulic fluid flow from the excavator to the hydraulic circuit. Moving from the unlocked position shown in FIG. 5 to the locked position of FIG. 3 by supplying the pressurized hydraulic fluid to the first hydraulic line 56 causes the spool valve 32 to return to its first position and also automatically opens the pressure-actuated sequence valve 34. As discussed above, when the locking actuator 20 is in the fully locked position shown in FIG. 3, the higher pressure incoming hydraulic fluid in first hydraulic line 56 is diverted to the pressure-actuated sequence valve 34 and the pressure in the flow passage leading to the sequence valve 34 increases until the sequence valve 34 opens above a threshold pressure. With the sequence valve 34 in the open position shown in FIG. 3, the hydraulic fluid being supplied through the spool valve 32 automatically begins to operate the hydraulic motor 52 and the vibratory mechanism 116, while at the same time preventing the locking actuator 20 from moving to an unlocked position.

INDUSTRIAL APPLICABILITY

A locking mechanism for a base plate 114 of a vibratory compactor 112 according to various embodiments of this disclosure provides a simple and inexpensive means for simultaneously controlling operation of the vibratory compactor and locking or unlocking of the base plate of the compactor. An operator of an excavator or other machine that includes the vibratory compactor as an attachment can control the direction of flow of hydraulic fluid between a source of pressurized hydraulic fluid on the machine and a hydraulic control circuit 10 of the vibratory compactor. The hydraulic control circuit is configured to supply the pressurized hydraulic fluid to both the hydraulic motor 52 for a vibratory mechanism 116 of the vibratory compactor 112 and a locking actuator 20 for engaging with the base plate 114 of the vibratory compactor 112. In applications where the vibratory compactor is provided as an attachment to a machine such as an excavator, an operator of the excavator can simply activate the hydraulic fluid supply valve 12 to reverse the direction of flow of the pressurized hydraulic fluid that is supplied during normal operation to operate the vibratory compactor. Reversing the direction of flow of the hydraulic fluid being supplied to the vibratory compactor 112 shuts off the vibratory mechanism 116 and unlocks the base plate 114. Under normal hydraulic flow conditions to the vibratory compactor during operation of the compactor, the hydraulic fluid will also automatically actuate the locking mechanism into a locked position and maintain the locked position to prevent disengagement of the base plate 114 from the vibratory compactor 112. Switching the direction of flow of the hydraulic fluid supplied to the vibratory compactor 112 can be performed with the simple, 3-position, solenoid-operated spool valve 12. The hydraulic motor 52 of the vibratory compactor 112 is configured to only operate when the hydraulic fluid is supplied from the excavator in a first direction.

The two-position hydraulic pilot-operated spool valve 32 is fluidly coupled to the source of pressurized hydraulic fluid and is part of the hydraulic control circuit 10 that supplies the pressurized hydraulic fluid to the hydraulic motor 52 for powering the vibratory mechanism(s) 116, and to the locking actuator(s) 20. The spool valve 32 is configured to sense a change in direction of flow of the hydraulic fluid supplied to the hydraulic control circuit 10 from the source of pressurized hydraulic fluid. Upon sensing the change in direction of flow of the hydraulic fluid, the spool valve 32 moves between the two positions of the spool valve. In a first position, the spool valve 32 directs pressurized hydraulic fluid from the source to a second chamber 24 of the locking actuator 20 to move the locking actuator 20 to a locked position. Once the locking actuator 20 has been moved to the fully locked position, the pressurized hydraulic fluid flowing through the spool valve 32 is automatically diverted to a flow passage leading to the pressure-actuated sequence valve 34, and upon reaching a threshold pressure the sequence valve 34 actuates to an open position. As shown in FIG. 3, once the sequence valve 34 is in the open position, the pressurized hydraulic fluid flows through the hydraulic motor 52 to rotate the hydraulic motor and power the vibratory mechanism 116.

A change in direction of the flow of hydraulic fluid to the spool valve 32 when the locking actuator is in the locked position moves the spool valve to the second position shown in FIGS. 4 and 5, and the hydraulic fluid is directed to the first chamber 22 of the locking actuator 20 to move the locking actuator 20 to the unlocked position shown in FIG. 5. The change in direction of the flow of hydraulic fluid to the spool valve 32 also results in the pressure-actuated sequence valve 34 closing and shutting off hydraulic fluid flow to the hydraulic motor 52.

As a result of the above-described hydraulic control circuit, a simple change in the direction of flow of the hydraulic fluid supplied to the hydraulic control circuit that is fluidly coupled to both the hydraulic motor for powering the vibratory compactor and the locking mechanism for locking the base plate results in locking of the base plate and operation of the vibratory mechanism, or stopping of the vibratory mechanism and unlocking of the base plate. An operator on the machine carrying the vibratory compactor doesn't have to learn or remember to make any other adjustments or perform control functions other than simply switching the direction of flow of the hydraulic fluid being supplied to the vibratory compactor 112 in order to shut off the vibratory mechanism 116 and unlock the base plate 114 of the compactor 112.

It will be apparent to those skilled in the art that various modifications and variations can be made in the disclosed exemplary embodiments of a locking mechanism for a base plate on a vibratory compactor without departing from the scope of the disclosure. Other embodiments of the disclosed locking mechanism will be apparent to those skilled in the art from consideration of the specification and practice of the locking mechanism and methods disclosed herein. It is intended that the specification and examples be considered as exemplary only, with a true scope of the disclosure being indicated by the following claims and their equivalents.

What is claimed is:

1. A locking mechanism for a base plate of a vibratory compactor, the locking mechanism comprising:

a locking actuator configured to alternately lock and unlock the base plate relative to the vibratory compactor; and a hydraulic control circuit in fluid communication with a source of pressurized hydraulic fluid and the locking actuator, the hydraulic control circuit including:

a hydraulic pilot-pressure-actuated, 2-position spool valve, wherein the spool valve is configured to move to a first position when pressurized hydraulic fluid from the source is supplied to the spool valve in a first direction, and move to a second position when the pressurized hydraulic fluid from the source is supplied to the spool valve in a second direction, and wherein:

in the first position of the spool valve the pressurized hydraulic fluid flows through the spool valve and through a first flow passage to a second side of the locking actuator to move the locking actuator to a locked position; and after the locking actuator is in the locked position, the pressurized hydraulic fluid flows through the spool valve and through a second flow passage to a hydraulic motor configured to power the vibratory compactor; and in the second position of the spool valve the pressurized hydraulic fluid flows through the spool valve and through a third flow passage to a first side of the locking actuator to move the locking actuator to an unlocked position; and after the locking actuator is in the unlocked position, the pressurized hydraulic fluid is diverted from the third flow passage to flow back to the spool valve and to the source.

2. The locking mechanism of claim 1, wherein hydraulic fluid flows from the first side of the locking actuator as the locking actuator moves to the locked position and passes through a pressure relief valve in a fourth flow passage back to the spool valve in the first position.

3. The locking mechanism of claim 2, wherein the hydraulic control circuit further includes a pressure-actuated sequence valve fluidly coupled to the spool valve in the second flow passage between the spool valve and the hydraulic motor, the sequence valve being configured to automatically open to allow fluid flow to the hydraulic motor above a first threshold pressure when the spool valve is in the first position and the locking actuator is in the locked position.

4. The locking mechanism of claim 3, wherein the hydraulic control circuit further includes a counter-balance valve and an associated bypass check valve fluidly coupled to the spool valve in the first flow passage between the spool valve and the second side of the locking actuator, the bypass check valve being configured to open to direct the pressurized hydraulic fluid around the counter-balance valve in a closed position to the second side of the locking actuator as the locking actuator is moved to the locked position with the spool valve in the first position, and the counter-balance valve remains closed as long as the pressure on the second side of the locking actuator is below a second threshold pressure.

5. The locking mechanism of claim 4, wherein the counter-balance valve is configured to open to allow hydraulic fluid from the second side of the locking actuator to flow back through the counter-balance valve if a large force on the locking actuator causes the pressure on the second side of the locking actuator to exceed the second threshold pressure.

6. The locking mechanism of claim 4, wherein hydraulic fluid flows from the second side of the locking actuator as the locking actuator moves to the unlocked position with the spool valve in the second position, and passes through the counter-balance valve in an open position in the first flow passage back to the spool valve in the second position.

7. The locking mechanism of claim 3, wherein the pressure-actuated sequence valve fluidly coupled to the spool valve in the second flow passage between the spool valve and the hydraulic motor remains in a closed position while the spool valve is in the second position and the locking actuator is in the unlocked position.

8. The locking mechanism of claim 7, wherein hydraulic fluid flowing from the spool valve in the second position through the third flow passage toward the locking actuator in the unlocked position is diverted through the pressure relief valve in the fourth flow passage back to the spool valve in the second position.

9. The locking mechanism of claim 4, wherein the counter-balance valve is in an open position in the first flow passage between the spool valve in the second position and the second side of the locking actuator while the locking actuator remains in the unlocked position.

10. A vibratory compactor, comprising:

a vibratory mechanism;

a hydraulic motor configured to drive the vibratory mechanism;

a removable base plate; and a locking mechanism for selectively engaging the removable base plate to retain the removable base plate on the vibratory compactor, the locking mechanism comprising:

a locking actuator configured to alternately lock and unlock the base plate relative to the vibratory compactor; and a hydraulic control circuit in fluid communication with a source of pressurized hydraulic fluid and the locking actuator, the hydraulic control circuit including:

a hydraulic pilot-pressure-actuated, 2-position spool valve, wherein the spool valve is configured to move to a first position when pressurized hydraulic fluid from the source is supplied to the spool valve in a first direction, and move to a second position when the pressurized hydraulic fluid from the source is supplied to the spool valve in a second direction, and wherein:

in the first position of the spool valve the pressurized hydraulic fluid flows through the spool valve and through a first flow passage to a second side of the locking actuator to move the locking actuator to a locked position; and after the locking actuator is in the locked position, the pressurized hydraulic fluid flows through the spool valve and through a second flow passage to the hydraulic motor; and in the second position of the spool valve the pressurized hydraulic fluid flows through the spool valve and through a third flow passage to a first side of the locking actuator to move the locking actuator to an unlocked position; and after the locking actuator is in the unlocked position, the pressurized hydraulic fluid is diverted from the third flow passage to flow back to the spool valve and to the source.

11. The vibratory compactor of claim 10, wherein hydraulic fluid flows from the first side of the locking actuator as the locking actuator moves to the locked position and passes through a pressure relief valve in a fourth flow passage back to the spool valve in the first position.

12. The vibratory compactor of claim 11, wherein the hydraulic control circuit further includes a pressure-actuated sequence valve fluidly coupled to the spool valve in the second flow passage between the spool valve and the hydraulic motor, the sequence valve being configured to automatically open to allow fluid flow to the hydraulic motor above a first threshold pressure when the spool valve is in the first position and the locking actuator is in the locked position.

13. The vibratory compactor of claim 12, wherein the hydraulic control circuit further includes a counter-balance valve and an associated bypass check valve fluidly coupled to the spool valve in the first flow passage between the spool valve and the second side of the locking actuator, the bypass check valve being configured to open to direct the pressurized hydraulic fluid around the counter-balance valve in a closed position to the second side of the locking actuator as the locking actuator is moved to the locked position with the spool valve in the first position, and the counter-balance valve remains closed as long as the pressure on the second side of the locking actuator is below a second threshold pressure.

14. The vibratory compactor of claim 13, wherein the counter-balance valve is configured to open to allow hydraulic fluid from the second side of the locking actuator to flow back through the counter-balance valve if a large force on the locking actuator causes the pressure on the second side of the locking actuator to exceed the second threshold pressure.

15. The vibratory compactor of claim 13, wherein hydraulic fluid flows from the second side of the locking actuator as the locking actuator moves to the unlocked position with the spool valve in the second position, and passes through the counter-balance valve in an open position in the first flow passage back to the spool valve in the second position.

16. The vibratory compactor of claim 12, wherein the pressure-actuated sequence valve fluidly coupled to the spool valve in the second flow passage between the spool valve and the hydraulic motor remains in a closed position while the spool valve is in the second position and the locking actuator is in the unlocked position.

17. The vibratory compactor of claim 16, wherein hydraulic fluid flowing from the spool valve in the second position through the third flow passage toward the locking actuator in the unlocked position is diverted through the pressure relief valve in the fourth flow passage back to the spool valve in the second position.

18. The vibratory compactor of claim 13, wherein the counter-balance valve is in an open position in the first flow passage between the spool valve in the second position and the second side of the locking actuator while the locking actuator remains in the unlocked position.

19. A vibratory compactor, comprising:

a vibratory mechanism;

a hydraulic motor configured to drive the vibratory mechanism;

a removable base plate; and a locking mechanism for selectively engaging the removable base plate to retain the removable base plate on the vibratory compactor, the locking mechanism comprising:

a locking actuator configured to alternately lock and unlock the base plate relative to the vibratory compactor; and a hydraulic control circuit in fluid communication with a source of pressurized hydraulic fluid and the locking actuator, the hydraulic control circuit being configured such that the only control input received by the control circuit from outside of the control circuit is the direction of flow of the pressurized hydraulic fluid supplied to the control circuit from the source of pressurized hydraulic fluid, and wherein:

flow of the hydraulic fluid in a first direction causes the locking actuator to lock the base plate relative to the vibratory compactor, and the hydraulic motor operates to drive the vibratory mechanism; and flow of the hydraulic fluid in a second direction opposite from the first direction causes the locking actuator to unlock the base plate relative to the vibratory compactor, and operation of the hydraulic motor is stopped.

20. The vibratory compactor of claim 19, wherein:

a pressure buildup in the hydraulic control circuit after the locking actuator is in a locked position automatically actuates a pressure-actuated sequence valve, which results in flow of the hydraulic fluid being diverted to the hydraulic motor.

* * * * *